US005806105A

United States Patent [19]

Yu

[11] Patent Number: 5,806,105

[45] Date of Patent: Sep. 15, 1998

[54] AUTOMATIC TOILET SEAT CLEANING SYSTEM

[76] Inventor: Yi Chieh Yu, Sec. 2, Hsintien, Taipei Hsien, Taiwan

[21] Appl. No.: 928,921

[22] Filed: Sep. 12, 1997

[51] Int. Cl.[6] ..... A47K 13/30

[52] U.S. Cl. ..... 4/233

[58] Field of Search ..... 4/233

[56] References Cited

U.S. PATENT DOCUMENTS

| | | | |
|---|---|---|---|
| 3,599,246 | 8/1971 | Bramati | 4/233 |
| 4,536,899 | 8/1985 | Sehnyder | 4/233 |
| 4,734,942 | 4/1988 | Blanchard | 4/233 |
| 4,790,036 | 12/1988 | Yogeli et al. | 4/233 |

*Primary Examiner*—Charles E. Phillips

*Attorney, Agent, or Firm*—Pro-Techtor International Services

[57] ABSTRACT

An automatic toilet seat cleaning system including a movable toilet seat supported on a toilet bowl of a toilet in front of a toilet water tank and moved between a front side position and a rear side position, a fixed first motor, a transmission mechanism controlled by the first motor to turn the toilet seat horizontally when the toilet seat is moved to the rear side position, a fixed second motor, a wheel brush turned by the second motor to clean the toilet seat when the toilet seat is moved to the rear side position and turned by the transmission mechanism, a waste water tank adapted to hold waste water falling from the movable toilet seat, a water tube adapted to guide clean water to the wheel brush for cleaning the toilet seat, and an electrical dryer controlled to dry the toilet seat.

4 Claims, 7 Drawing Sheets

AUTOMATIC TOILET SEAT CLEANING SYSTEM

BACKGROUND OF THE INVENTION

The present invention relates to an automatic toilet seat cleaning system installed in a toilet for cleaning a toilet seat.

A toilet seat of a toilet must be frequently cleaned so as to prevent a contamination. However, it is not practical to clean a toilet seat of a public toilet after each use. In order to prevent a contamination, some people may sit on the heels above the toilet seat when emptying the bowels. However, it is not comfortable to sit on the heels when emptying the bowels, and sitting on the toilet seat may cause a damage to the toilet seat.

SUMMARY OF THE INVENTION

The present invention has been accomplished under the circumstances in view. It is one object of the present invention to provide an automatic toilet seat cleaning system which can be conveniently controlled to automatically clean the toilet seat before or after an use of the toilet. It is another object of the present invention to provide an automatic toilet seat cleaning system which cleans the toilet seat quickly. According to one aspect of the present invention, the automatic toilet seat cleaning system comprises a movable toilet seat supported on a toilet bowl of a toilet in front of a toilet water tank and moved between a front side position and a rear side position, a fixed first motor, a transmission mechanism controlled by the first motor to turn the toilet seat horizontally when the toilet seat is moved to the rear side position, a fixed second motor, a wheel brush turned by the second motor to clean the toilet seat when the toilet seat is moved to the rear side position and turned by the transmission mechanism, a waste water tank adapted to hold waste water falling from the movable toilet seat, a water tube adapted to guide clean water to the wheel brush for cleaning the toilet seat, and an electrical dryer controlled to dry the toilet seat. According to another aspect of the present invention, a chemical dispenser is provided and controlled to dispense antiseptic to water passing through the water tube when the system is started. According to still another aspect of the present invention, an electrical heating member is mounted inside the toilet seat and controlled to produce heat for warming the toilet seat.

DETAILED DESCRIPTION OF THE PREFERRED EMBODIMENT

Figure 1:
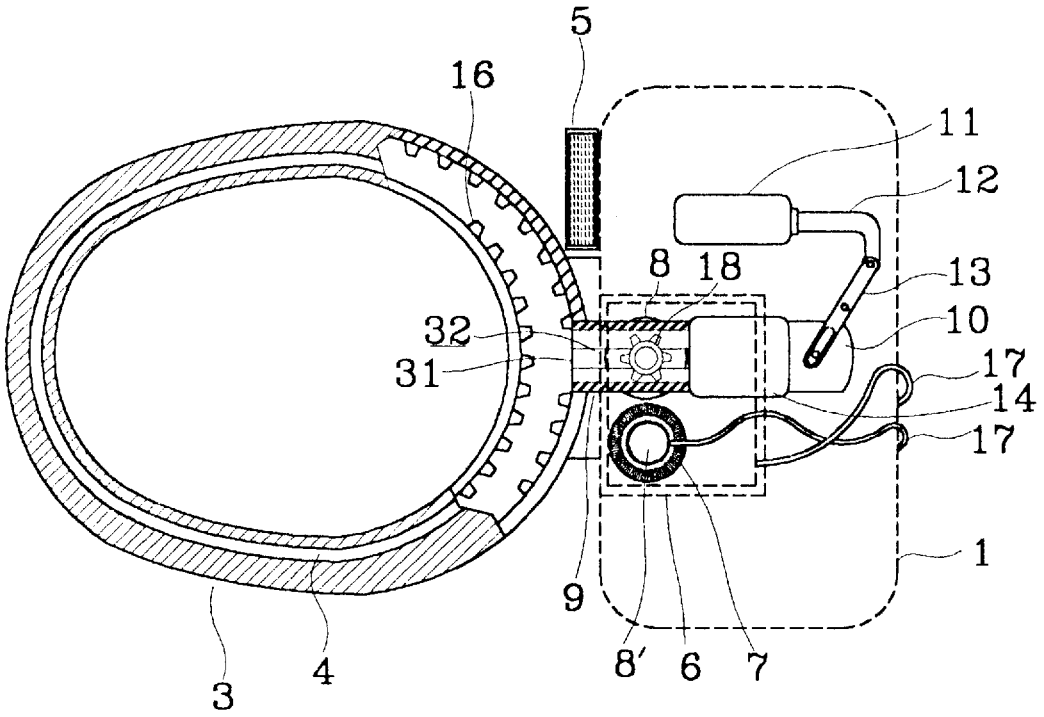
FIG. 1 is a top plain view of an automatic toilet seat cleaning system according to the present invention.
Figure 2:
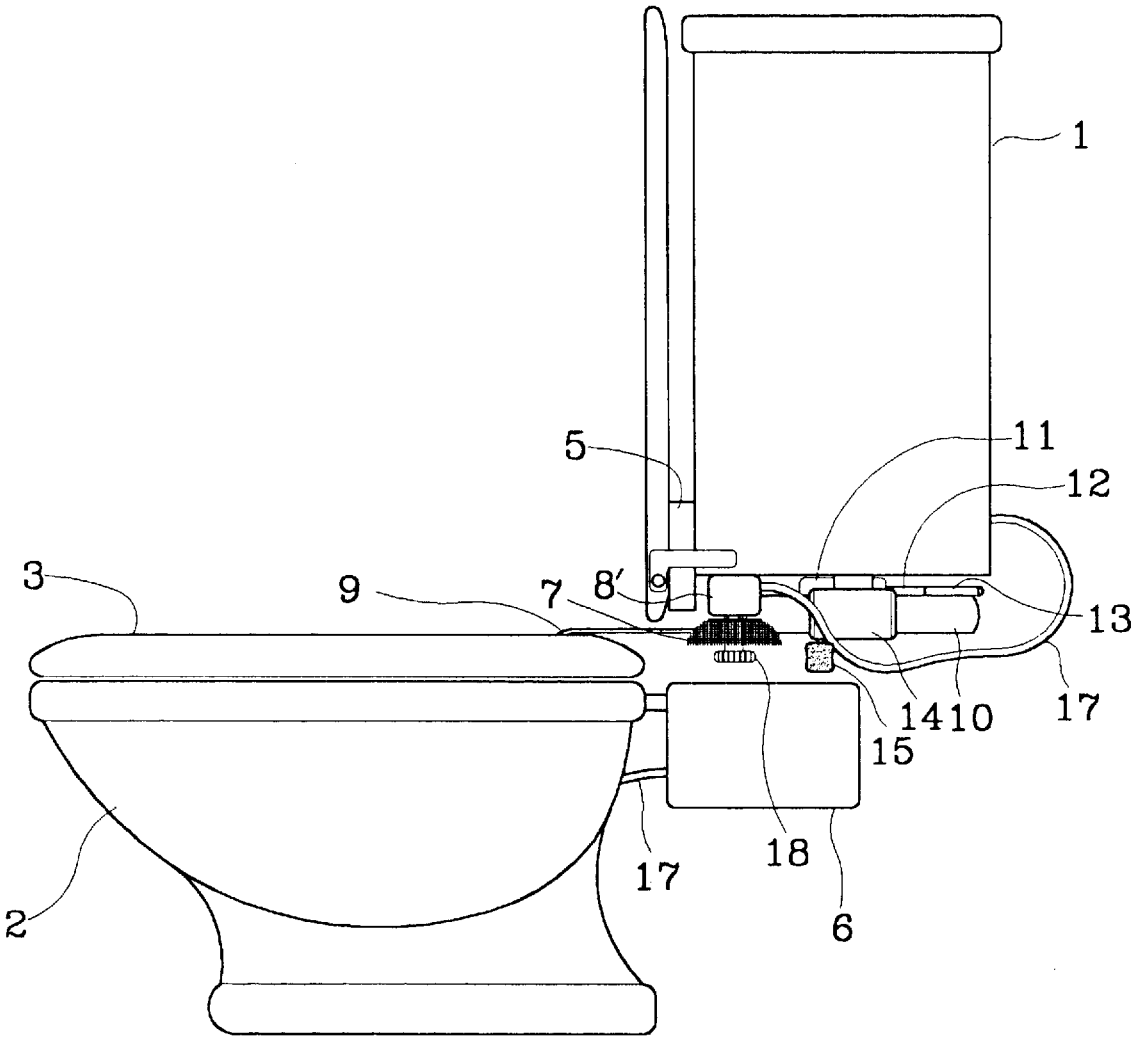
FIG. 2 is a side view of the automatic toilet seat cleaning system shown in FIG. 1.

Referring to FIGS. 1 and 2, a waste water tank 6 is fixedly fastened to a water tank 1 of a toilet behind its toilet bowl

2. A movable toilet seat 3 is supported on the toilet bowl 2. The toilet seat 3 has an opening 31 at its rear side. Two racks 16 are mounted on two opposite vertical side walls of the toilet seat 3 on the inside. A bar 9 is provided having a front end inserted into the opening 31 of the toilet seat 3, and a rear end terminating in a guide rod 10. The bar 9 has an elongated sliding slot 32. A first motor 8 is provided having a downwardly extended motor shaft (not shown) inserted through the sliding slot 32 of the bar 9 from the top, and a gear 18 fixedly mounted on the motor shaft. The guide rod 10 is inserted through a sleeve 14. A link 13 is provided having one end coupled to the guide rod 10, and an opposite end coupled to a reciprocating rod 12 of an electromagnetic valve 11. A rubber wheel 15 is mounted on a bottom side of the sleeve 14. A second motor 8' is fixedly mounted on the water tank 1 at the bottom. A wheel brush 7 is coupled to the second motor 8' and suspended above the waste water tank 6 at one side of the bar 9. A water tube 17 is provided for guiding water from the water tank 1 (or city water supply pipe) to the wheel brush 7. An electrical dryer 5 is mounted on a front side of the water tank 1.

Figure 3:
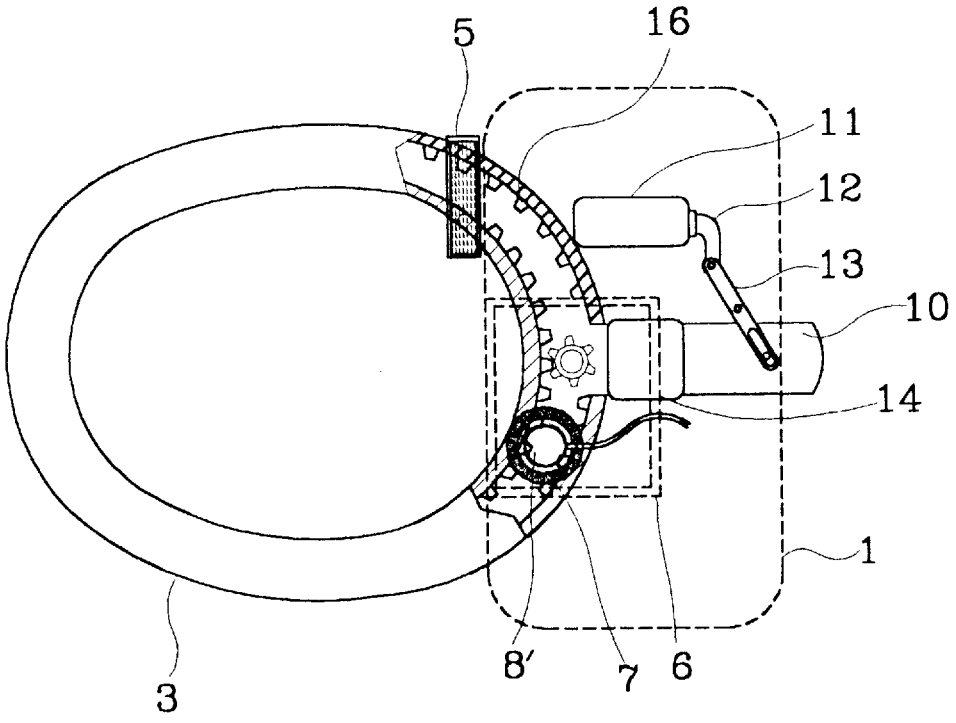
FIG. 3 is similar to FIG. 1 but showing the toilet seat moved to the back side, the gear of the first motor meshed with the teeth of the toilet seat.
Figure 4:
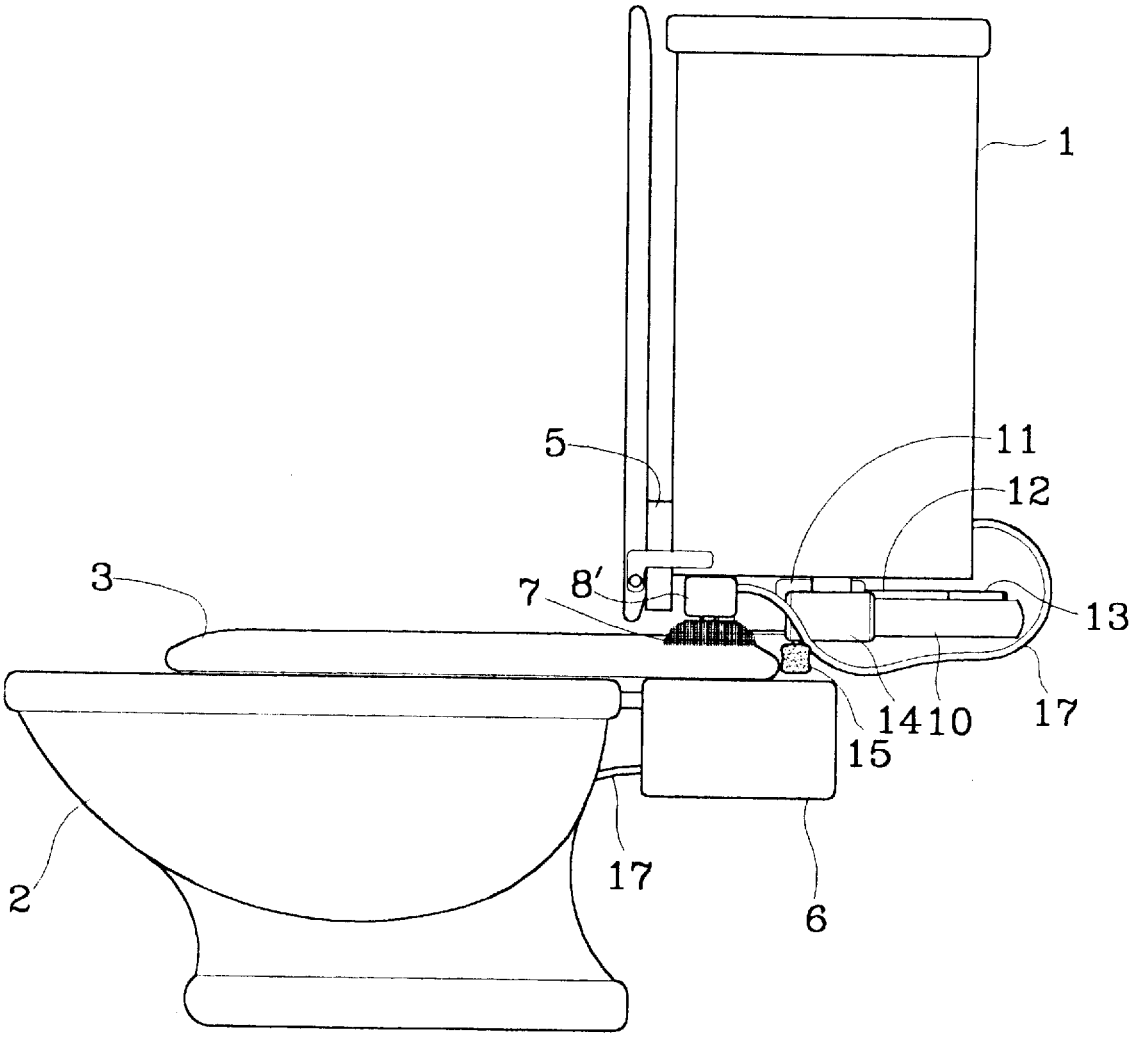
FIG. 4 is a similar to FIG. 2 but showing the toilet seat moved to the back side.
Figure 5:
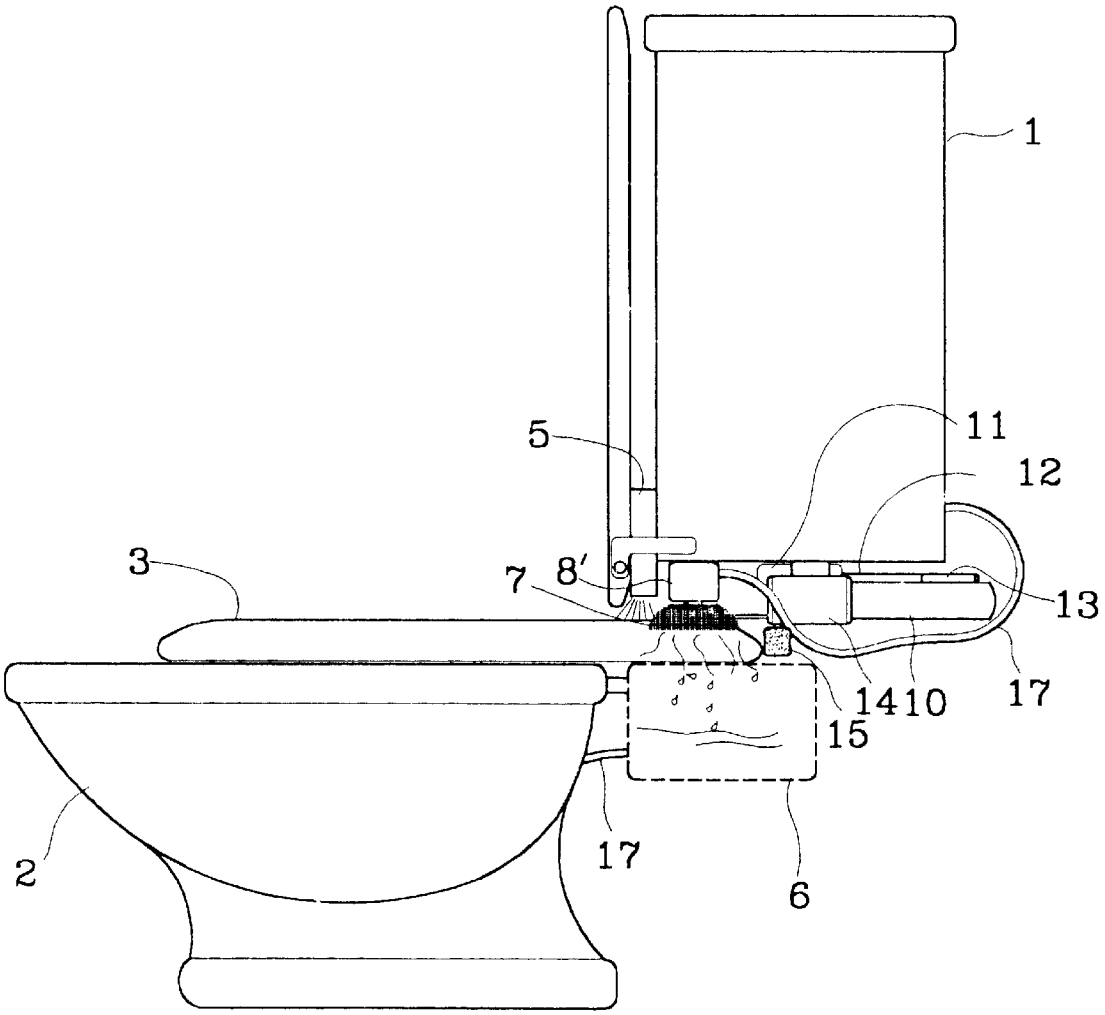
FIG. 5 is similar to FIG. 4 but showing the wheel brush and the electrical dryer operated.

Referring to FIGS. 3 and 4, the electromagnetic valve 11, the motors 8;8' and the electrical dryer 5 are controlled by a control circuit (not shown). The control circuit is controlled by a switch or infrared sensor. Because the control circuit is achieved by conventional techniques and not within the scope of the invention, it is not described herein in detail. When the user wishes to use the toilet or after an use of the toilet, the control circuit is started to drive the electromagnetic valve 11, causing it to extend out the reciprocating rod 12. When the reciprocating rod 12 is extended out, the guide rod 10 is pulled backwards by the link 13, and the toilet seat 3 is moved backwards with the bar 9. When the toilet seat 3 is moved to the back side, it is disposed in contact with the wheel brush 7 and stopped at the rubber wheel 15, and the racks 16 of the toilet seat 3 are forced into engagement with the gear 18, and at the same time the control circuit starts the second motor 8', causing it to turn the wheel brush 7 over the top side of the toilet seat 3. When the wheel brush 7 is turned to brush the toilet seat 3, clean water is guided by the water tube 17 to the wheel brush 7 for cleaning (see FIG. 5). A chemical dispenser may be connected to the water tube 17, and controlled by the control circuit to send antiseptic or perfume to water passing through the water tube 17.

Figure 6:
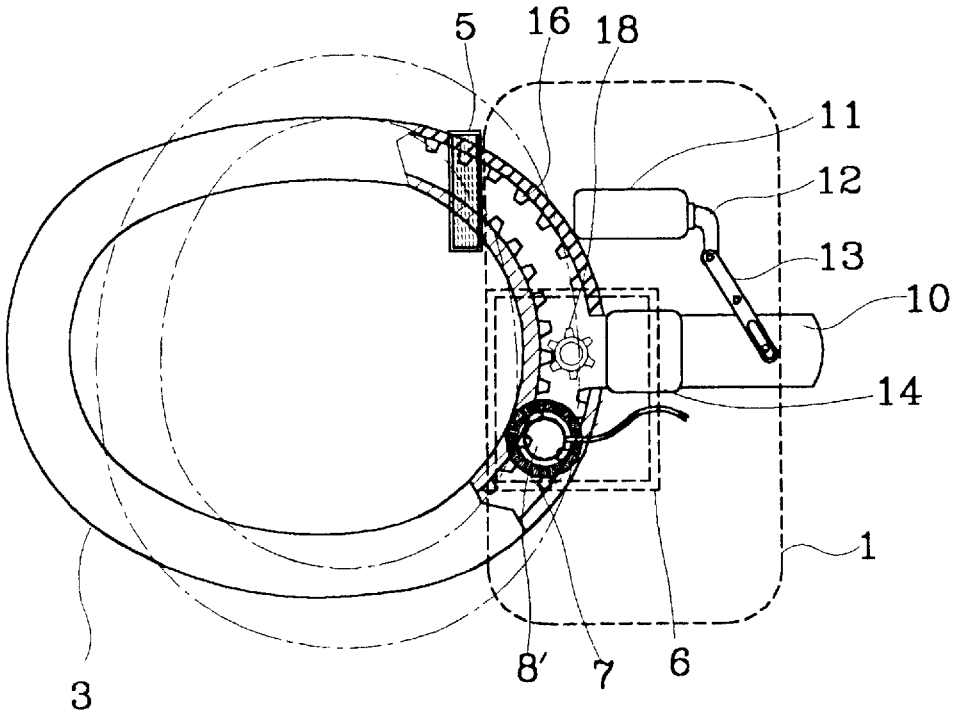
FIG. 6 is a schematic drawing showing the toilet seat turned according to the present invention.

Referring to FIG. 6, when the first motor 8 is started, the gear 18 is rotated. Because the gear 18 is engaged with the racks 16 of the toilet seat 3 when the toilet seat 3 is moved to the back side, the toilet seat 3 is rotated horizontally and moved over the wheel brush 7. Therefore, the whole area of the top side of the toilet seat 3 can be well cleaned. During cleaning, waste water is collected by the waste water tank 6 and then guided from the waste water tank 6 to the toilet bowl 2, and the electrical dryer 5 is turned on to blow hot air toward the toilet seat 3, causing the cleaned part of the toilet seat 3 to be quickly dried. When the toilet seat 3 is turned through one run, the control circuit stops the operation of the automatic toilet cleaning system and then enters the stand-by mode.

The aforesaid electrical driver 5 is preferably provided with a swivel air nozzle tube for output of hot air, so that the user can turn the swivel air nozzle tube upwards for drying the hands.

Further, an electrical heating member 4 is mounted within the toilet seat 3, and controlled by the control circuit to produce heat of about 40° C. for drying the inside of the toilet seat 3 and keeping the toilet seat 3 warm.

Figure 7:
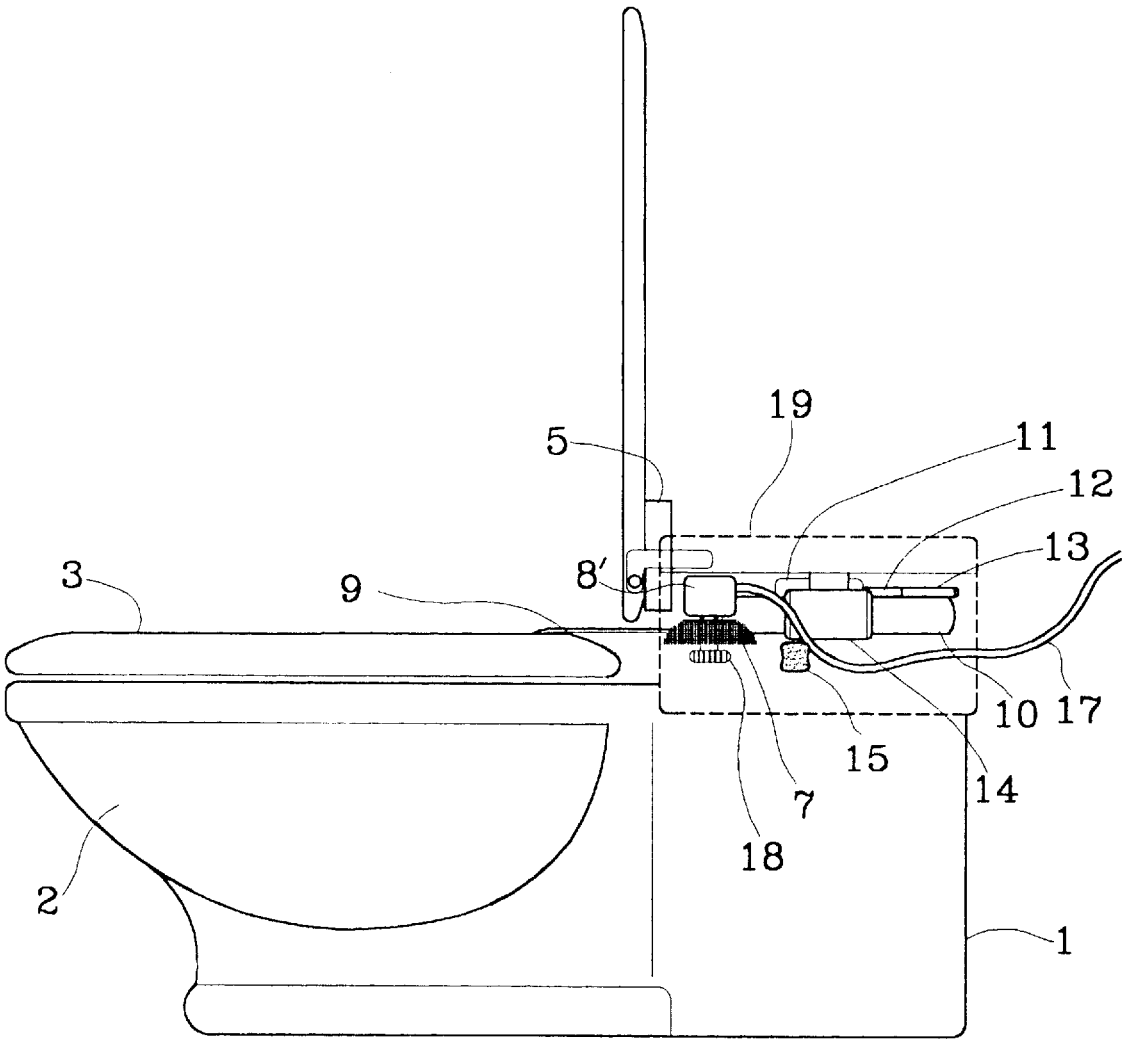
FIG. 7 is a side view of an alternate form of the present invention.

FIG. 7 shows an alternate form of the present invention, in which a casing 19 is mounted on the toilet water tank 1 at the top to hold the automatic toilet cleaning system; the water tube 17 extends out of the casing 19 and connected to a water tap of a water supply system.

It is to be understood that various modifications and changes could be made thereunto without departing from the spirit and scope of the invention disclosed.

What the invention claimed is:

1. An automatic toilet seat cleaning system comprising:

a movable toilet seat supported on a toilet bowl of a toilet in front of a toilet water tank;

an electromagnetic valve controlled reciprocating mechanism controlled to move said movable toilet seat between a front side position and a rear side position;

a fixed first motor;

a fixed second motor;

a transmission mechanism controlled by said fist motor to turn said toilet seat horizontally when said toilet seat is moved to said rear side position, said transmission mechanism comprising two racks fixedly mounted on two opposite vertical side walls of said toilet seat on the inside, and a gear coupled to said first motor, said racks being forced into engagement with said gear when said toilet seat is moved to said back side position;

a wheel brush turned by said second motor to clean said toilet seat when said toilet seat is moved to said rear side position and turned by said first motor through said transmission mechanism;

a waste water tank adapted to hold waste water falling from said movable toilet seat when said movable toilet seat is moved to said rear side position and cleaned by said wheel brush;

a water tube adapted to guide clean water to said wheel brush for cleaning said toilet seat; and an electrical dryer mounted on a front side of said toilet water tank and controlled to dry said toilet seat.

2. The automatic toilet seat cleaning system of claim 1 further comprising a chemical dispenser adapted to dispense antiseptic to water passing through said water tube.

3. The automatic toilet seat cleaning system of claim 1 further comprising an electrical heating member mounted inside said toilet seat and controlled to produce heat for warming said toilet seat.

4. The automatic toilet seat cleaning system of claim 1 further comprising a casing holding the whole assembly of the system.

* * * * *